United States Patent [19]

Wood

[11] 4,439,109

[45] Mar. 27, 1984

[54] PUMP FOR PUMPING A LIQUID CONTAINING SOLID CONTAMINANTS

[75] Inventor: Robert S. Wood, Gosport, England

[73] Assignee: Plessey Overseas Limited, Ilford, England

[21] Appl. No.: 328,246

[22] Filed: Dec. 7, 1981

[30] Foreign Application Priority Data

Dec. 5, 1980 [GB] United Kingdom ..... 8039113

[51] Int. Cl.[3] ..... F01C 21/04

[52] U.S. Cl. ..... 418/88; 418/89

[58] Field of Search ..... 418/88, 89; 417/368, 417/372, 319, 313; 415/175, 121 R, 9

[56] References Cited

U.S. PATENT DOCUMENTS 824,187 6/1906 Lowe ..... 418/88 X 2,500,719 3/1950 Ungar ..... 418/88

2,767,658 10/1956 Murray ..... 417/319 X 3,372,646 3/1968 Pinkas et al. ..... 418/89 X

*Primary Examiner*—Edward R. Look

*Attorney, Agent, or Firm*—Fleit, Jacobson, Cohn & Price

[57] ABSTRACT

A pump for pumping a liquid containing solid contaminants, which pump comprises rotatable pumping means for pumping the liquid from a pump inlet to a pump outlet, a filter for filtering the liquid, auxiliary pumping means for pumping the liquid to the filter, first passage means for passing filtered liquid to at least one bearing in the pump for lubrication, a rotor device which is operative during use of the pump to cause the liquid inside the filter to swirl and clean the inside of the filter, and second passage means for allowing the passage of unfiltered liquid from the inside of the filter whereby the unfiltered liquid can remove separated solid contaminants on the inside of the filter.

7 Claims, 1 Drawing Figure

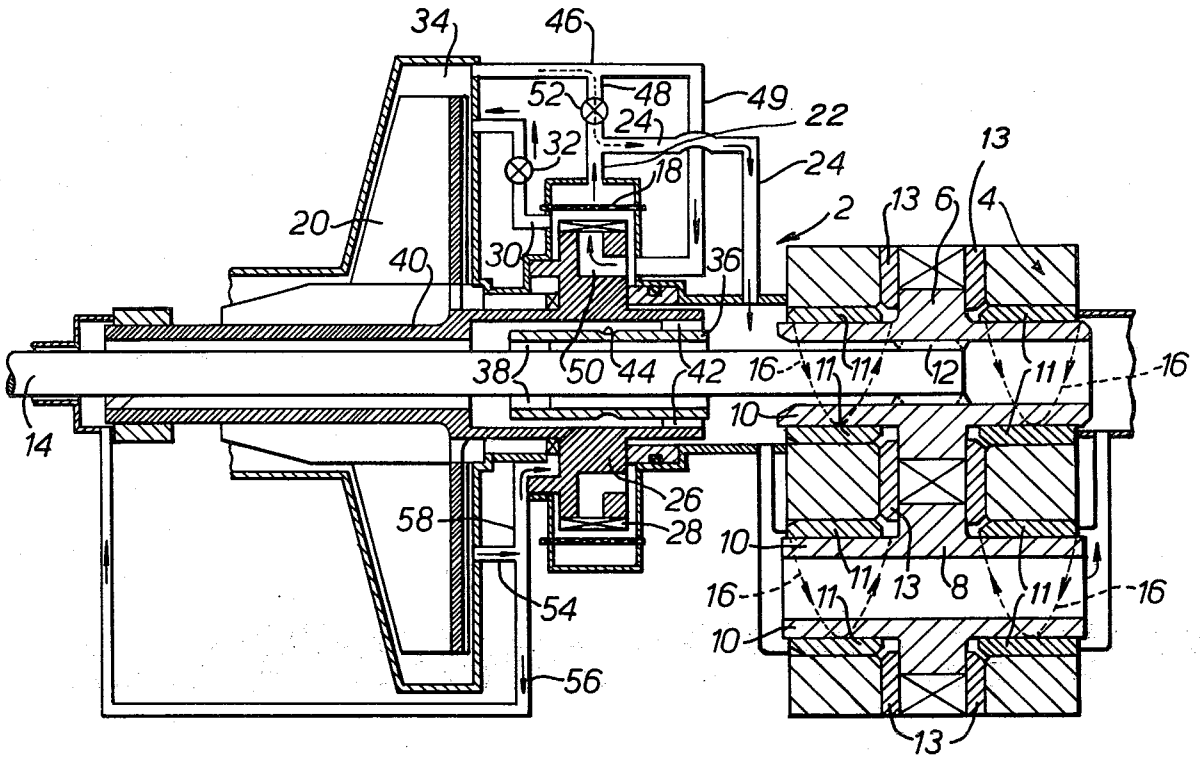
16
16
11
11
13
4
6
12
8
13
13
13
11
11
11
11
2
22
24
49
16
10
10
16
10
36
42
26
28
48
24
18
44
46
52
32
50
54
56
30
38
34
40
58
20
14

PUMP FOR PUMPING A LIQUID CONTAINING SOLID CONTAMINANTS

BACKGROUND OF THE INVENTION

1. Field of the Invention

This invention relates to a pump for pumping a liquid containing solid contaminants.

2. Description of the Prior Art

It often occurs that pumps are required to pump a liquid containing solid contaminants. The solid contaminants can cause undersirable pump wear, for example in the pump journals.

Some parts of a pump must of necessity operate in the contaminated liquid. For example, if the pump is a gear pump with side plates, then the gears will usually be made of a hard wear-resistant material. The side plates may be made of a softer material and they will therefore wear. However the wear of the side plates is usually in a uniform manner so that they remain flat and still seal perfectly for the life of the pump. The journal bearings must not be allowed to wear to any considerable extent and so they must be supplied with a lubricant. It is advantageous for the lubricant to be pumped liquid from which the solid contaminants have been removed. The cleaned liquid can also effect cooling of the journals.

Sometimes liquids are pumped that have only slight lubricative properties, for example some presently used fuels for aircraft engines. This means that more cleaned liquids must be desirably supplied to areas requiring lubrication than when liquids are being pumped that have better lubricative properties. Furthermore, because of the low lubricative properties, the cleaned liquids must desirably be cleaned to a greater extent that liquids having further lubricative properties. For example, it may be necessary to clean the liquids having low lubricative properties so well that they are free from solid contaminants larger than 2 to 3 microns particle size.

SUMMARY OF THE INVENTION

It is an aim of the present invention to provide a pump that gives particularly efficient cleaning of liquids containing solid contaminants.

Accordingly, this invention provides a pump for pumping a liquid containing solid contaminants, which pump comprises rotatable pumping means for pumping the liquid from a pump inlet to a pump outlet, a filter for filtering the liquid, auxiliary pumping means for pumping the liquid to the filter, first passage means for passing filtered liquid to at least one bearing in the pump for lubrication, a rotor device which is operative during use of the pump to cause the liquid inside the filter to swirl and clean the inside of the filter, and second passage means for allowing the passage of unfiltered liquid from the inside of the filter whereby the unfiltered liquid can remove separated solid contaminants on the inside of the filter.

Preferably, the rotatable pumping means is a pair of intermeshing gears. Other types of pumping means may however be employed.

The filter may be a wire mesh filter. Other types of filters may be employed such for example as a thin sheet metal filter having fine holes drilled in it by a laser.

Preferably, the rotor device is positioned inside the filter since the rotor device then acts as a centrifugal pump and provides extra pressure to pass the liquid to be filtered through the filter. The rotor device may then have radially extending blades which terminate adjacent the inside of the filter. Alternatively, and if desired, the rotor device may be mounted outside the filter. This latter arrangement may be advantageous with a tubular filter if the inlet pressure is high enough to overcome the centrifugal pressure generated by the rotor device, the dirty liquid being partially cleaned by centrifuging forces before passing through the filter.

In one embodiment of the invention, the pump is one in which the rotatable pumping means is fixed to a drive shaft by a permanent connection, and in which the auxiliary pumping means and the rotor device are fixed to the drive shaft by a releasable connection which is releasable if the auxiliary pumping means or the rotor device should seize during operation of the pump whereby the releasable connection can release to leave the auxiliary pumping means and the rotor device stationary about the drive shaft with the rotatable pumping means still rotating with the drive shaft, and the pump including third passage means for passing unfiltered liquid to the first passage means when the releasable connection has released.

Preferably, the releasable connection is a shear connection.

The first, second and third passage means may each comprise a groove or grooves, or a bore or bores.

The third passage means may be provided with a device giving a high resistance to flow of the liquid in the direction from the third passage means to the first passage means, and a low resistance to flow of the liquid from the first passage means to the third passage means. The device is advantageously a vortex valve.

BRIEF DESCRIPTION OF THE DRAWING

An embodiment of the invention will now be described solely by way of example and with reference to the accompanying drawing which is a cross section through a pump for pumping a liquid containing solid contaminants.

DESCRIPTION OF THE PREFERRED EMBODIMENT

Referring to the drawings, there is shown a pump 2 which is a fuel pump for pumping liquid in the form of a fuel which is contaminated with abrasive solid contaminants. The pump 2 comprises rotatable pumping means 4 constituted by a pair of gears 6, 8 which intermesh as shown and which are supported on journals 10. The journals 10 run in bearings 11. The journal 10 for the gear 6 is permanently connected at position 12 to a drive shaft 14. The gears 6, 8 operate against independent sealing side plates 13 and the gears 6, 8 and the side plates 13 must of necessity operate in the dirty fuel. The gears 6, 8 are made of a hard wear-resistant material. The side plates 13 are made of a softer material and they do wear but they wear in a uniform manner so that they remain flat and seal perfectly for the life of the pump.

The journals 10 for the gears 6, 8 must not be allowed to wear to any considerable extent and in the pump 2 they are supplied with relatively clean fuel, the fuel acting as a lubricant and as a coolant. The fuel passes around the journals 10 by passing along lubricant passageways 16 formed in the outer surface of the journals 10.

The pump 2 further comprises a pump inlet (not shown) and a pump outlet (not shown). The gears 6, 8 are effective to pump the fuel from the pump inlet to the pump outlet.

A filter 18 is provided for filtering the dirty fuel. The dirty fuel is pumped to the filter by means of auxiliary pumping means in the form of a centrifugal backing pump, the rotor of which is shown as rotor 20. The rotor 20 is effective to boost the pressure of the fuel entering the gears 6, 8.

First passage means in the form of conduits 22, 24 are provided for passing the filtered fuel to the lubricant passageways 16 in the journals 10.

A rotor 26 having outwardly extending peripheral blades 28 is positioned over the drive shaft 14 and inside the filter 18. The blades 28 terminate just short of the inside of the filter 18. Rotation of the drive shaft 14 causes the rotor 26 to rotate. The rotation of the rotor 26 causes the fuel inside the filter 18 to swirl and also to be slightly increased in pressure. The swirling fluid can either pass through the filter 18 and be cleaned or it can scrub the inside of the filter 18 to remove already filtered solid contaminants from the inside of the filter 18. The removed solid contaminants can pass along second passage means in the form of a conduit 30. The conduit 30 has an orifice 32 and the dirty fuel with the solid contaminants from the inside of the filter 18 can pass through the orifice 32 and back into a chamber 34 in which the rotor 20 operates.

A sleeve member 36 is permanantly fixed to the drive shaft 14 at position 38. A longer sleeve member 40 which supports the rotor 20 and the rotor 26 is permanantly fixed to the sleeve member 36 at position 42. The sleeve member 36 is provided with a shear section 44, the purpose of which will be described hereinbelow.

The pump 2 comprises third passage means in the form of conduits 46, 48 for passing unfiltered liquid when desired to the conduit 24 of the first passage means.

During normal operation of the pump 2, dirty fuel is sucked through the pump inlet by the rotor 20 and the dirty fuel passes from the chamber 34 along conduit 46, then along conduit 49 and into chamber 50 in the rotor 26. The fuel then passes out through the periphery of the rotor 26 between the blades 28 and swirls inside the filter 18. The fuel that passes through the filter 18 is filtered and a proportion of this filtered fuel passes along conduits 22, 24 to the lubricant passageways 16. Filtered clean fuel that is not required to pass along the conduits 22, 24 passes through an orifice 52 in the conduit 48 and it can then pass into the conduit 49 for recirculation and refiltering. Fuel not passing through the filter 18 tends to scrub the inside of the filter 18 clean and remove the solid contaminants. This fuel with the solid contaminants then passes along conduit 30 and through the orifice 32 into the chamber 34 for recirculation as described above. The orifice 52 is preferably arranged to be in the form of a vortex valve having a high resistance to flow to the fuel passing from conduit 22 to conduit 48 and a low resistance to flow to fuel passing from conduit 48 to conduit 22. The high resistance to flow is achieved due to centrifugal back pressure to the vortex valve and the low resistance to flow is achieved by the absence of induced whirl in the required direction when the fuel is passing from conduit 48 to conduit 22 as described above. It will thus be seen that during normal operation of the pump 2, the required amount of filtered clean fuel passes along the conduits 22, 24 to lubricate the journals 10.

The pump 2 is so designed that in the event that the rotors 20 or 26 should seize and cease to rotate, the pump 2 can still operate to the extent that the gears 6, 8 will still be in operation and the journals 10 will still receive some lubrication, although this lubrication will be effected by dirty fuel. This dirty fuel will however enable the pump 2 to continue to operate for a short period of time without undue wear occuring in the journals 10. When the rotors 20 or 26 cease to rotate, the shear section 44 will shear and so the drive shaft 14 will no longer drive the rotors 20, 26. The rotors 20, 26 will stay stationery about the rotating drive shaft 14. The drive shaft 14 will however still continue to rotate the gears 6, 8 via the permanant connection at the position 12 to the gear 6. When the rotors 20, 26 cease to rotate, dirty fuel in the conduit 46 can pass from conduit 48 in the direction of conduit 22 and along conduit 24 to the journals 10. The passage of fuel in this direction is assisted by the fact that the orifice 52 permits easier flow in the direction of conduit 48 to conduit 22 rather than from conduit 22 to conduit 48. When the rotor 20 is stationery, the journal lubrication flow is effectively at gear pump inlet pressure. The lubrication flow, as propelled by the rotation of the gears 6,8, induces by fluid drag, a flow in the spiral lubrication passageways 16 towards the faces of the gears, where the lubrication liquid is discharged into the gear pump inlet.

Fuel from the chamber 34 can also pass along conduits 54, 56 and between the drive shaft 14 and the sleeve member 40 to lubricate the drive shaft 14 as it rotates during operation of the pump 2. Fuel from the conduit 54 can also pass along conduit 58 to lubricate the side faces of the rotor 26 and the bearing of rotor 20 as they rotate.

It is to be appreciated that the embodiment of the invention described above has been given by way of example only and that modifications may be effected. Thus, for example, the pump 2 may operate other than with the gears 6, 8. When the pump 2 is used in aircraft applications, then the rotor 20 will normally be required but if the pump 2 is used in other applications, then the rotor 20 may be dispensed with if the rotor 26 is capable of providing sufficient pressure rise to propel the liquid through the filter 18 and the bearings.

I claim:

1. A pump for pumping a liquid containing solid contaminants, which pump comprises rotatable pumping means for pumping the liquid from a pump inlet to a pump outlet, a filter for filtering the liquid, auxiliary pumping means for pumping the liquid to the filter, first passage means for passing filtered liquid to at least one bearing in the pump for lubrication, a rotor device which is operative during use of the pump to cause the liquid inside the filter to swirl and clean the inside of the filter, and second passage means for allowing the passage of unfiltered liquid from the inside of the filter whereby the unfiltered liquid can remove separated solid contaminants on the inside of the filter.

2. A pump according to claim 1 in which the rotatable pumping means is a pair of intermeshing gears.

3. A pump according to claim 1 or claim 2 in which the filter is a wire mesh filter.

4. A pump according to claim 1 in which the rotor device is positioned inside the filter.

5. A pump according to claim 4 in which the rotor device has radially extending blades which terminate adjacent the inside of the filter.

6. A pump according to claim 1 in which the rotatable pumping means is fixed to a drive shaft by a permanent connection, and in which the auxiliary pumping means and the rotor device are fixed to the drive shaft by a releasable connection which is releasable if the auxiliary pumping or the rotor device should seize during operation of the pump whereby the releasable connection can release to leave the auxiliary pumping means and the rotor device stationary about the drive shaft with the rotatable pumping means still rotating with the draft shaft, and the pump including third passage means for passing unfiltered liquid to the first passage means when the releasable connection has released.

7. A pump according to claim 6 in which the releasable connection is a shear connection.

* * * * *